United States Patent [19]

O'Brien et al.

[11] 4,424,011

[45] Jan. 3, 1984

[54] PAINTING APPLICATOR WITH REMOTE SUPPLY

[75] Inventors: Lawrence B. O'Brien; Walter F. Winston, both of Carmel; Edmund L. Abner; Lowell G. Atkinson, both of Indianapolis; H. Richard Roudebush, Greenfield; William L. Buehler, Indianapolis; Jim K. Bergstresser, Indianapolis; Walker A. Messick, Indianapolis, all of Ind.

[73] Assignee: Triune Automated Painting Systems, Carmel, Ind.

[21] Appl. No.: 218,354

[22] Filed: Dec. 22, 1980

[51] Int. Cl.[3] ..... F04B 45/08; B43K 5/02

[52] U.S. Cl. ..... 417/477; 401/149

[58] Field of Search ..... 417/477, 63; 401/197, 401/208, 188 R, 149, 150

[56] References Cited

U.S. PATENT DOCUMENTS

| | | | |
|---|---|---|---|
| 2,662,666 | 12/1953 | Lamport | 417/477 |
| 2,987,004 | 6/1961 | Murray | 417/477 |
| 3,227,092 | 1/1966 | Clark, Jr. | 417/477 |
| 3,756,752 | 9/1973 | Stenner | 417/477 |
| 3,822,948 | 7/1974 | Handl | 417/477 |
| 3,981,618 | 9/1976 | Nelson, Jr. | 417/42 |
| 4,025,241 | 5/1977 | Clemens | 417/477 |
| 4,070,725 | 1/1978 | Austin et al. | 417/477 |

*Primary Examiner*—Richard E. Gluck

*Assistant Examiner*—Cuomo Peter M.

*Attorney, Agent, or Firm*—Woodard, Weikart, Emhardt & Naughton

[57] ABSTRACT

A paint roller is provided with a removable sleeve receiving a cover having a pile on a stretchable flexible backing. A reversible, speed controllable pump on a hand cart provides paint to the roller from a supply under control of a switch at the roller handle. The roller handle contains a radio transmitter for transmission of pump control signals to a receiver in a pump housing mounted to the hand cart. A peristaltic pump is used for the pumping, and is reversible to facilitate draining of the system back to the paint source. Opening of a door on the pump housing releases pump roller pressure from pump tubing, provides access to pump rollers and pump tubing, and thereby facilitates installation and removal of the pump tubing. Conventional water hose fittings are provided to facilitate cleaning by connection to a hose bib of a domestic water system, if desired. The entire unit is conveniently transportable on a three-wheel cart and provided with a lamp for illuminating the work, and electric power supply for the pump. A spear type intake tube is available for puncturing a paint can and removing paint directly through a punctured lid thereof, without opening the can. The cart includes a well to receive a conventional five gallon paint can, and a well to receive the roller, which well may also be used to facilitate cleaning. There is a swivel coupling on the paint supply line to the roller feed line.

2 Claims, 9 Drawing Figures

PAINTING APPLICATOR WITH REMOTE SUPPLY

BACKGROUND OF THE INVENTION

1. Field of the Invention

This invention relates generally to application of fluidized coatings to rather large areas on surfaces which are usually stationary, typically walls and ceilings of structures. It relates more particularly to a system of maintaining a supply of the coating material to an applicator device constantly, as needed, while the applicator device is in use.

2. Description of the Prior Art

The prior art in painting apparatus is extensive. Dispensers include brushes, pads, rollers, air pressurized sprayers, airless sprayers, and electrostatic dispensers. Perhaps there are others. The various types have advantages and disadvantages. Those of main interest with reference to the present application are those involving contact-type applicators, and especially rollers, brushes and pads. Of the prior art in this area, perhaps the most pertinent is that shown in U.S. Pat. No. 3,457,017 issued July 22, 1969 to James W. Bastian. It discloses a system in which a peristaltic pump, possibly of the type disclosed in his earlier U.S. Pat. No. 3,353,491, is coupled to a roller or pad-type applicator. A motor control switch is mounted on the applicator handle to control the motor for supply of paint from a reservoir to the roller or pad, as needed.

Although the above-mentioned Bastian patent does not show a wheeled carriage to enhance portability of the paint reservoir and pump while operating, U.S. Pat. No. 3,230,570 issued Jan. 25, 1966 to Flippen and cited in the Bastian patent, discloses a wheeled carriage including a paint container, a peristaltic pump, and a roller assembly for painting floors, parking lots, driveways, or the like. The Russell and Fisher patents, cited as references in the Flippen patent, also disclose wheeled carriages supporting paint containers (the Russell container being pressurized) and supplying paint to a paint striping brush in the case of Russell, and two discs in the Fisher patent for wet lime marking of athletic fields and the like. While these particular references disclose the use of wheeled carriages for ground marking machines, a fairly recent U.S. Pat. No. 4,072,429, issued Feb. 7, 1978 to Terzian et al. discloses a wheeled carriage having a built-in peristaltic pump for supplying paint from a can through a hose to a wall-painting roller handle. A well is provided in the carriage to receive a paint can from which the intake tube to the pump draws paint. A storage well 124 is provided in the housing for storage of the paint intake tube 44 and the paint delivery tube 56 after use. A bracket 36 is provided on the carriage for hanging the paint roller thereon. A storage compartment 60 in the bottom of the housing is provided on the carriage for storage of the electric cord for the pump motor.

SUMMARY OF THE INVENTION

Described briefly, according to a typical embodiment of the present invention, the painting applicator includes a roller assembly supplied from a pump mounted on a hand cart and having reversible electric motor drive to apply rollers to a compressable tube for pumping purposes. The tube intake is from a conventional paint can received in a nest on the cart with a piercing intake spear through the paint can lid. Discharge is through hoses to a swivel coupling on a handle assembly coupled to the tubular support axle of the roller.

Access door means on the pump housing provides window observation of the pump tubing when engaged by the pump pressure rollers. Means are provided for release of loading on the pump tubing, including pump roller shifting means operable upon opening the access door, to release pump roller force from the pump tubing.

BRIEF DESCRIPTION OF THE DRAWINGS

FIG. 6A is a fragmentary section taken at line 6A-6A in FIG. 5 and showing the door and pump base sealing the periphery of the pump hose near the discharge end.

FIG. 6B is an elevational view at line 6B—6B in FIG. 6 and viewed in the direction of the arrows to show a fragment of the interior face of the door at the base seal gasket.

DESCRIPTION OF THE PREFERRED EMBODIMENT

Figure 1:
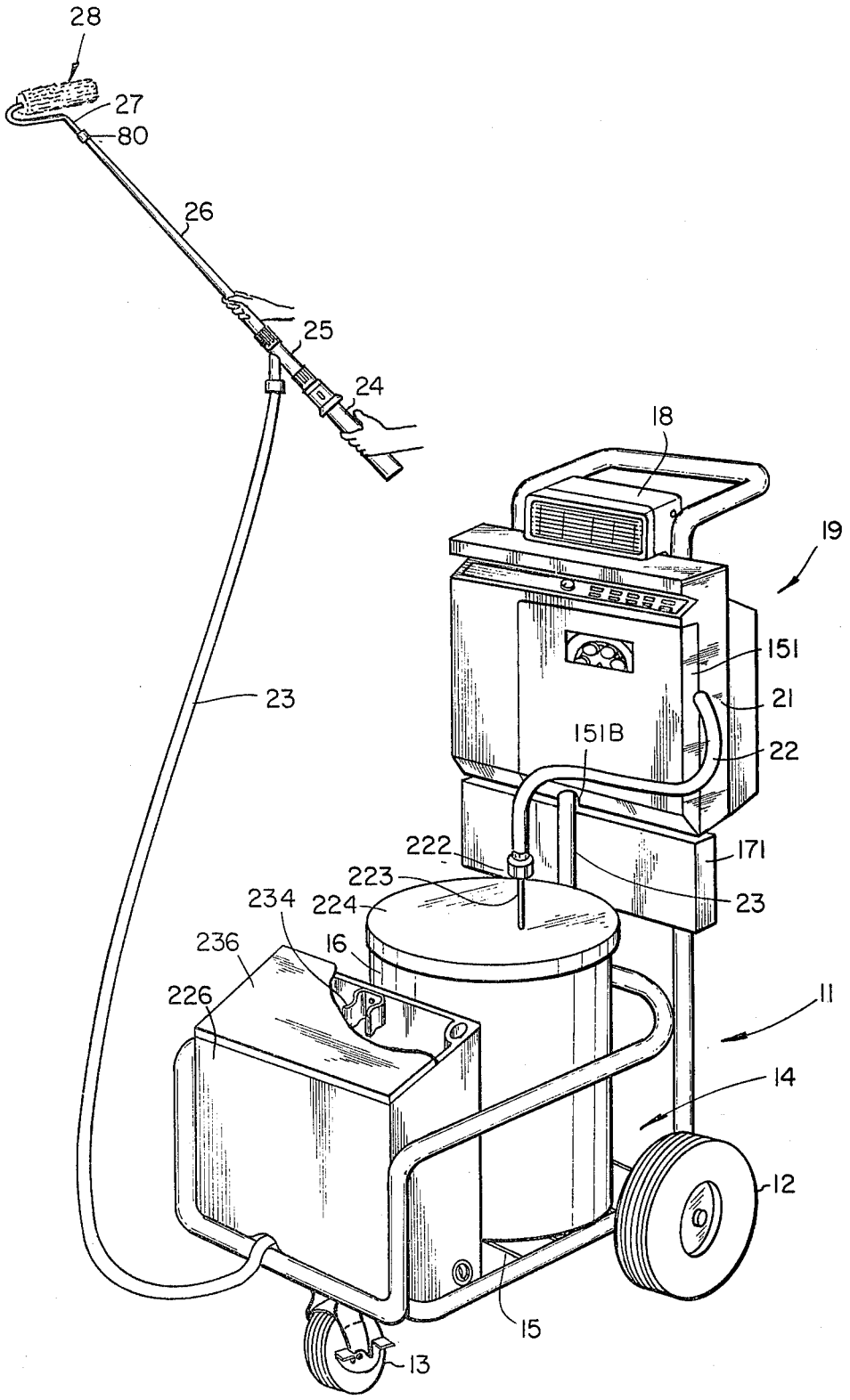
FIG. 1 is a frontal perspective view of a painting applicator with remote supply according to a typical embodiment of the present invention.
Figure 2:
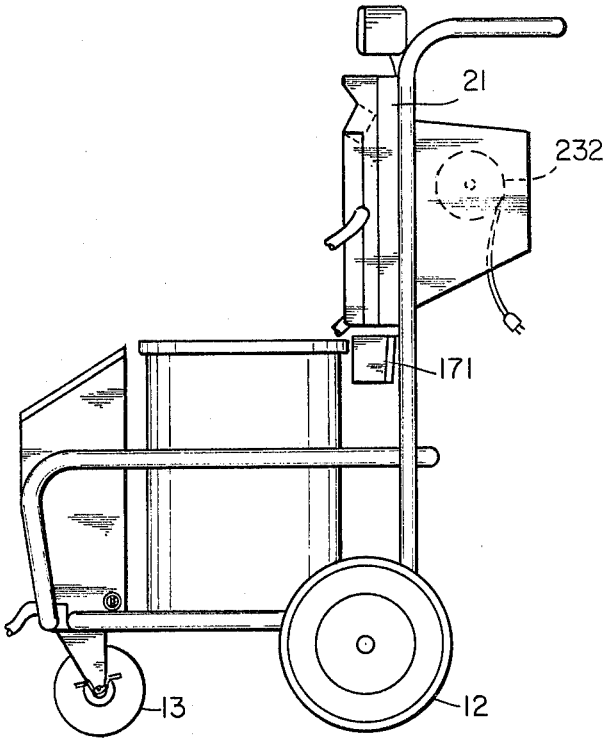
FIG. 2 is a side elevational view thereof.
Figure 4:
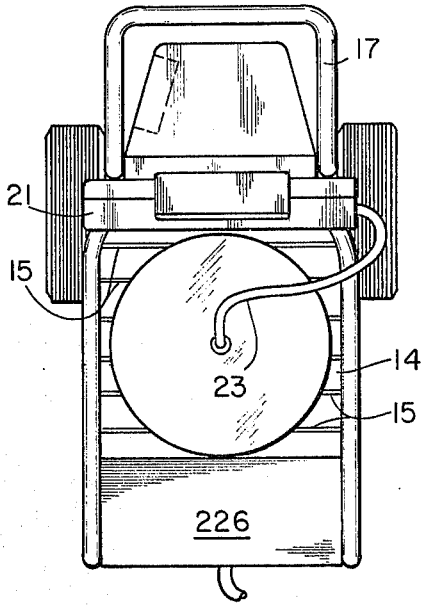
FIG. 4 is a top plan view of the typical embodiment.

Referring now to FIG. 1, the machine includes a three wheeled cart 11 of tubular metal construction with two wheels 12 at one end and a caster wheel 13 at the other. The cart includes a nest 14 (FIG. 4) of small horizontal support rods 15 cooperating with the tubing of the cart frame and receiving a paint can 16 (typically of the five gallon size). Inverted U-shaped handle 17 is provided at rear of the cart and serves as a mount for a pump assembly having a light 18 on it to assist in illuminating the work.

A pump assembly 19 is mounted to the handle 17 and includes a housing 21 with a motor therein driving a pump, the details of which cannot be seen in FIG. 1 but are shown in some of the other drawings.

The pump has an inlet hose 22, and discharge hose 23, the latter being connected to a handle 24 by a swivel coupling assembly 25. A handle extension tube 26 is connected to the swivel coupling assembly 25, and a roller mounting tube 27 is connected to the distal end of tube 26. Roller assembly 28 is mounted to the roller mounting tube and receives the paint supplied by the pump.

Referring again to FIGS. 1–6, it was mentioned that there is a pump housing 21. There is a front door provided at 151 with hinges (195, 196 FIG. 7) at the left side whereby the door can be opened to the position shown in FIGS. 6 and 7 where it exposes the pump tube 152 received in a cavity 159 in a stationary wall 153 in the pump housing. One wall of the cavity 159 is a cam surface 154 which generally faces downward and to the right to support the hose against forces directed generally upward and to the left. The pump tube is connected to the inlet hose 22 at a coupling 156, and it is connected to the discharge hose 23 at coupling 157.

A rotor 158 is received in the pump cavity 159 and supports six rollers, three of them being flat faced pressure rollers 161, and three of them being grooved, hose confining and reforming idler rollers 162 of the same outside diameter (O.D.) as the pressure rollers. The rotor 158 rotates about a horizontal axis 163 at its center and which is perpendicular to the plane of operation of the rollers.

Figure 3:
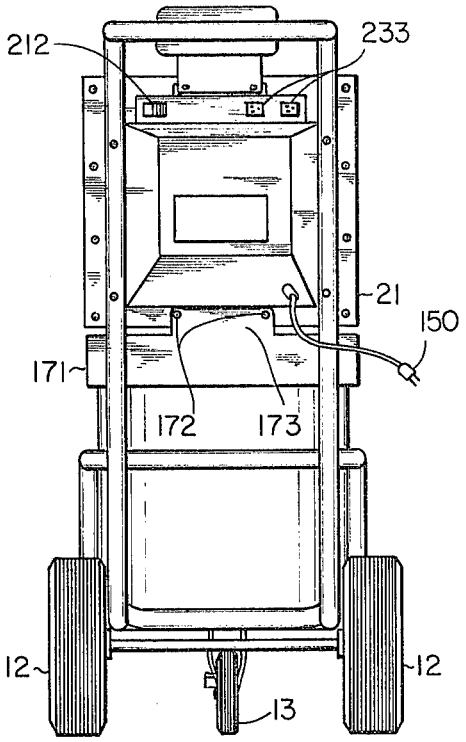
FIG. 3 is a rear elevational view thereof.

The pump cavity is provided with a drain passageway 164 with a lamp 166 focused upward through a window in the bottom of the horizontally extending portion of the drain passageway onto photo cell 167 for detection of passage of any fluid down through the drain passageway, and which would be indicative of a leak in the pump assembly. An open topped safety tray 171 (shown in FIGS. 1–3 and 5) is located under the drain passageway outlet and extends the full width of the pump housing to receive any leakage from passageway 164. It is hung on the back of the housing 21 by a pair of hooks 172 through eyes on a hanger portion 173 of the trough (FIG. 3). A notch 168 in the edge of the door 151 (FIG. 6) accommodates the hose 22, when the door is closed.

Figure 5:
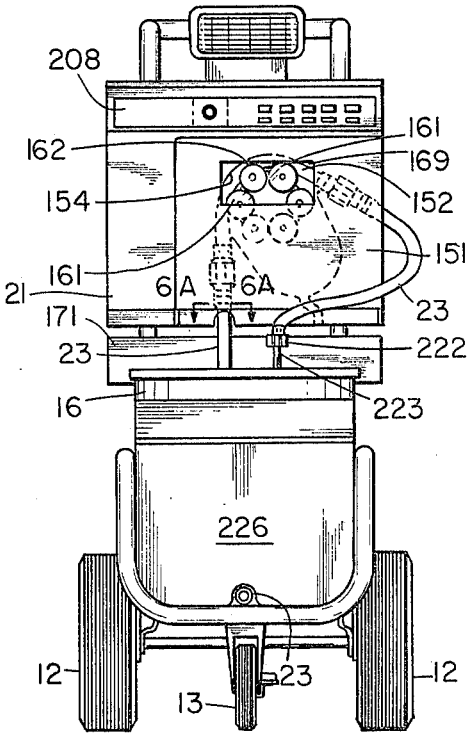
FIG. 5 is a front elevational view thereof with the pump tube access door closed.
Figure 6:
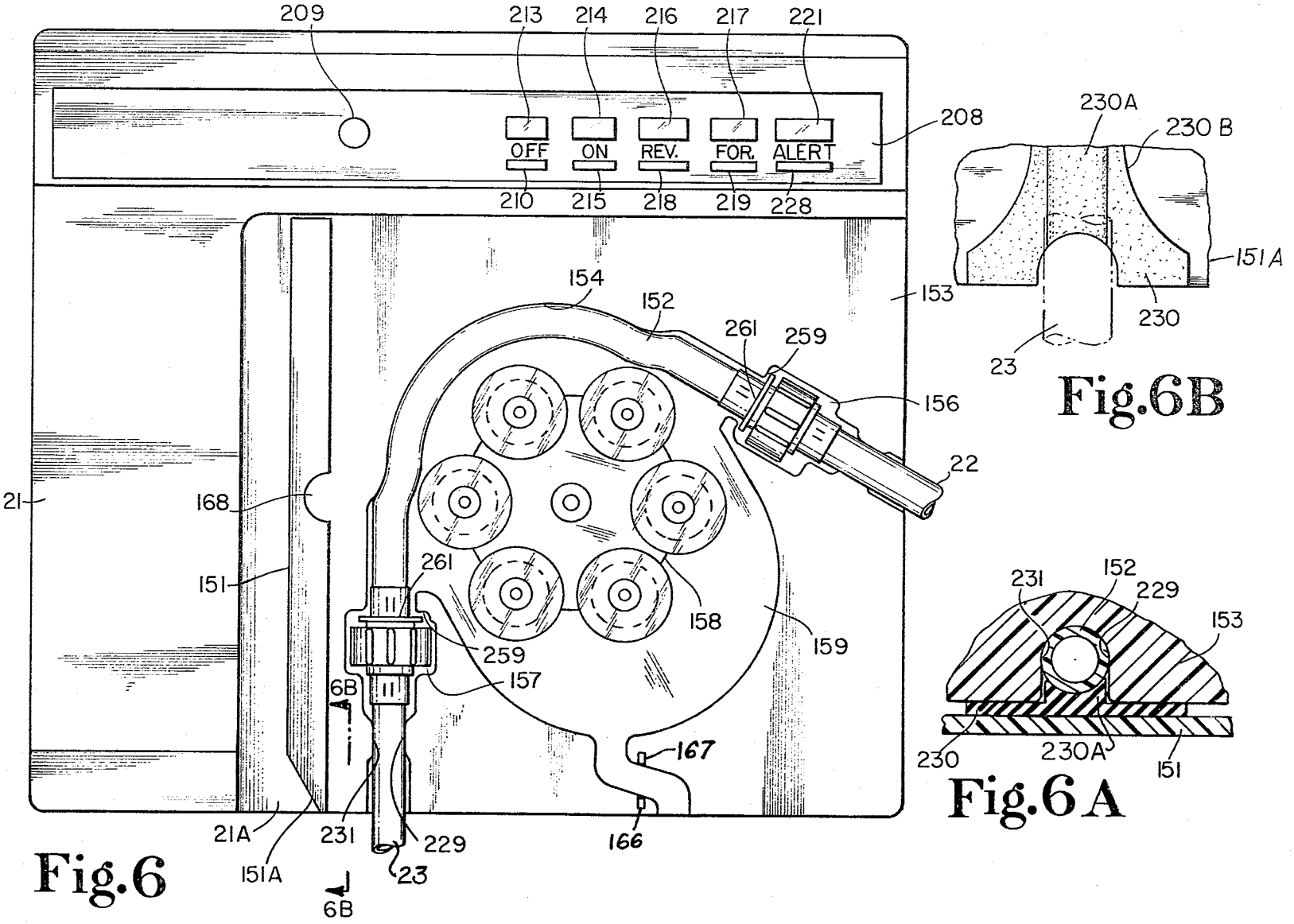
FIG. 6 is a fragmentary enlarged front view with the pump access door open.

As shown in FIG. 5, when the door is closed, one can see a portion of the pump through the window 169. It may be noted in this view that the pressure rollers 161 have forced the lower portion of the pump tube toward the cam surface 154, and the idler roller 162 also is in position of engagement with the pump tube. The shifting of the pump rotor and rollers from the tube compressing position shown in FIG. 5 to the tube release position of FIG. 6 is accomplished simultaneously with the opening of the door in a manner which will now be described with reference to FIGS. 19 through 21.

Figure 7:
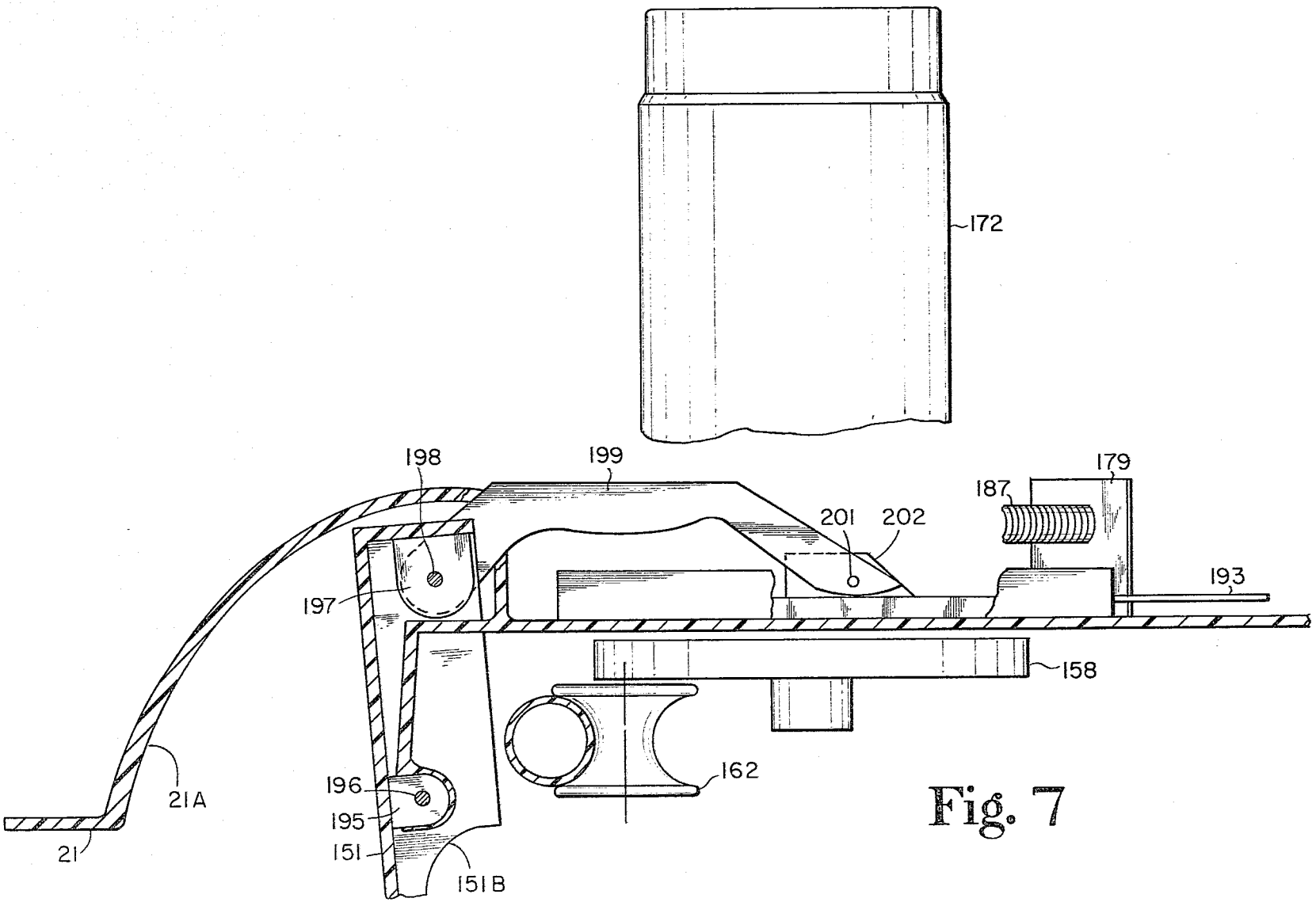
FIG. 7 is a fragmentary top plan view showing the pump motor and mounting portions and door linkage for loading and unloading the pump tube.
Figure 8:
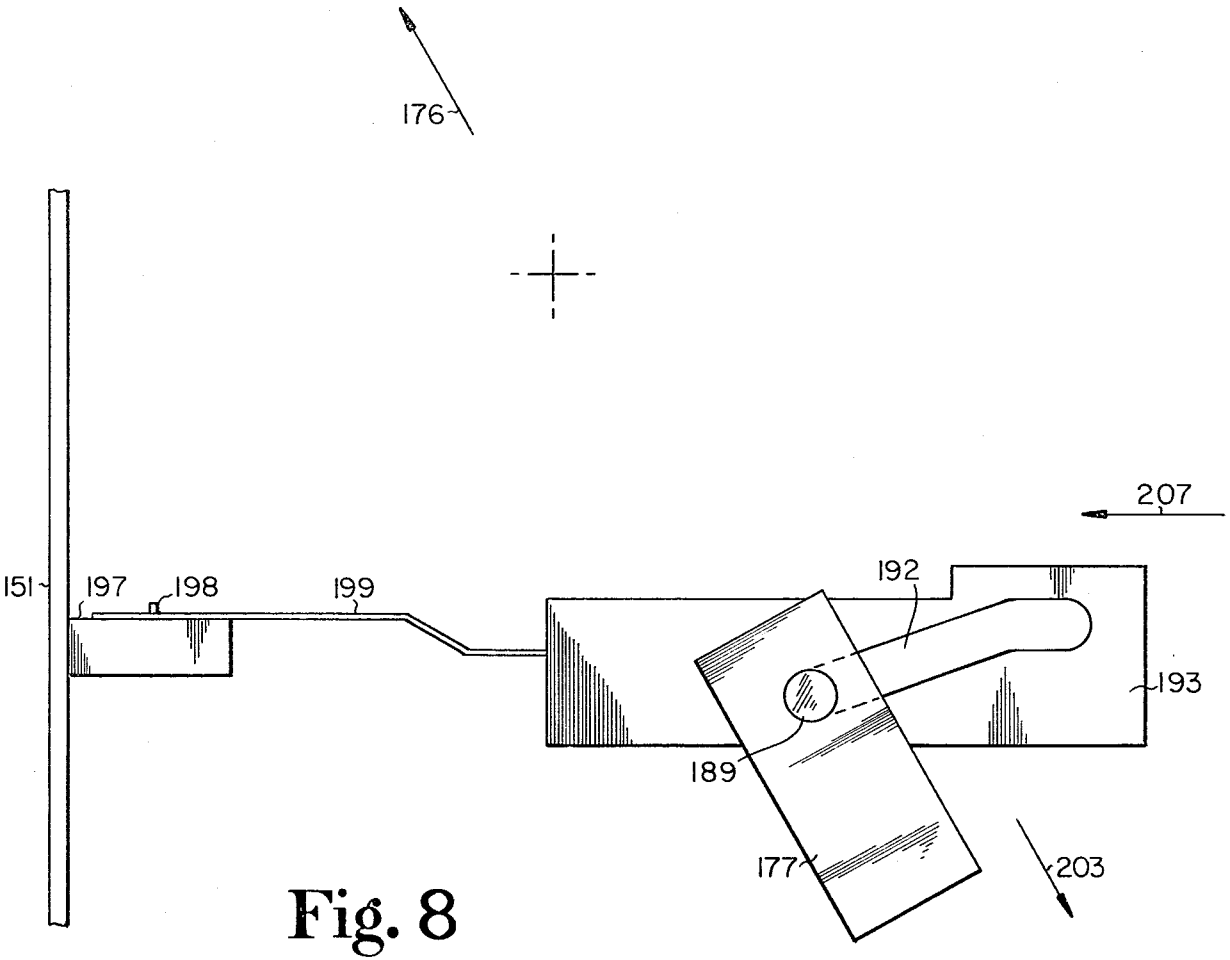
FIG. 8 is a front elevational view of the door linkage.
Figure 9:
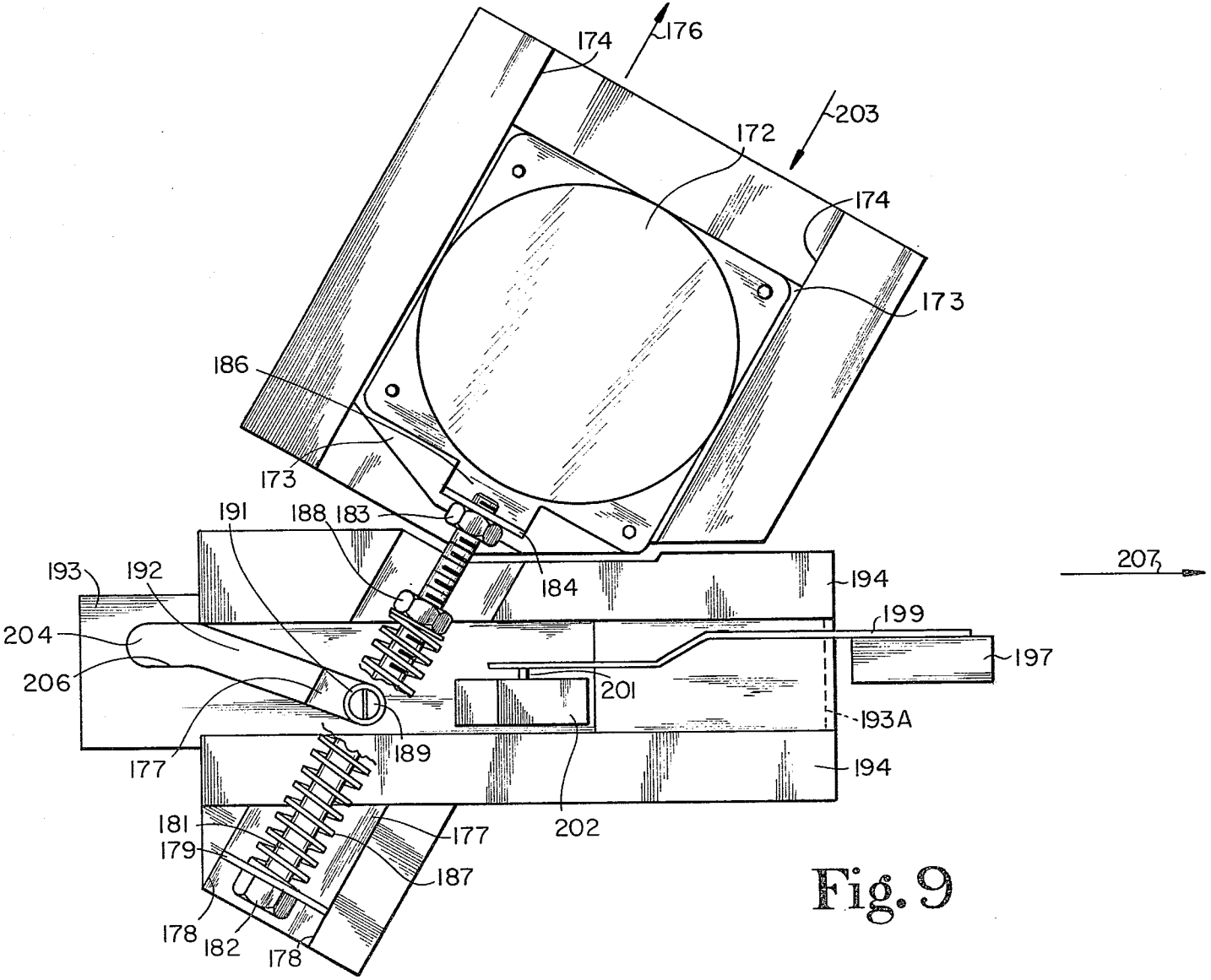
FIG. 9 is a rear elevational view thereof.

Referring now to FIGS. 7, 8 and 9, a reversible motor 172 is mounted to a slide 173 received in tracks 174 so that the motor can be moved in the direction of arrow 176 (FIG. 9). The tracks 174 are in permanent fixed relationship to the cam surface 154. The rotor 158 is secured to the motor shaft so that when the motor is moved in the direction of arrow 176, the rotor is moved in the same direction toward the cam surface 154 to apply the rollers to the pump tube 152.

A slide 177 is received in tracks 178 (FIG. 9) which have a fixed relationship to tracks 174. Slide 177 has a flange 179 with an aperture therein receiving the shank 181 of bolt 182 therethrough. This bolt is threaded into the flange 184 of bracket 186 secured to the slide 173. Nut 183 serves as an adjustment fixing jam nut against flange 184. A coil spring 187 is seated on flange 179, and the upper end of the spring bears on a nut 188 which is threaded on the shank 181 of bolt 182. A pin 189 secured in the slide 177 has a cam follower roller bearing 191 received thereon and which is received in a cam slot 192 in a horizontal slide 193. Slide 193 is received in tracks 194. The tracks 178 and 194 are in fixed relationship to the cam surface 154, as are the tracks 174.

The door 151 has hinge brackets 195 which mount on a vertical hinge pivot axis 196 on the pump housing and which has a fixed relationship to the cam 154. The arm 197 on the rear of the door is fastened by a pin 198 to a link 199, the other end of which is pinned at 201 to a bracket 202 secured to the back of the slide 193.

As the door is opened from the closed position, link 199 pushes slide 193 from the dotted line position 193A to the solid line position. As it does so, the cam follower roller 191 on pin 189 on slide 177 is moved downward in the direction of arrow 203 (FIGS. 8 and 9). As it does so, it pulls slide 177 downward in the same way which, through flange 179 bolt 182, flange 184 and slide 173 on the motor base pulls the motor downward in the direction of arrow 203 to pull the rollers away from the pump tube 152. Accordingly, all of these parts have the position shown in the solid lines in FIGS. 6, 7, 8 and 9. When the door is again closed, the cam follower roller 191 moves up the cam slot 192 until it enters the reverse ramp portion 204 of this cam slot, whereupon the downward resilient force exerted by the pump tube against which the pump rollers are then bearing, tends to urge the pin downward in the reverse ramp portion 204 of slot 192 and thereby hold the door shut. In other words, the force in the direction of arrow 203 against the pump rollers by the pump tube, urges the cam follower roller 191 against the lower face 206 of the cam slot end portion 204, thereby slightly urging the slide 193 in the direction of arrow 207.

Longitudinal adjustment of the nut 188 on the bolt 182 will establish the return force in the spring 187. This can establish the amount of paint pressure which can be developed in the pump tube before the tube will push the pump rollers away in the direction of arrow 203 against the spring force. It thereby limits the pump pressure, even though the door remains shut and the cam follower roller 191 remains in the cam slot end portion 204.

Referring to FIG. 3, switch 212 at the top rear of the housing is for power to the unit. Since this unit may be radio controlled from the handle 24, it is preferable to have a power switch 212 to power up the radio receiver and make power available to the pump motor, subject only to the control functions. The radio receiver and control electronics are integrated on one circuit board 205 (dotted in FIG. 2) behind control panel 208. A pump motor controller 200 by Dart Controls Inc., 5000 W. 106th Street, Zionsville, Ind., Model No. 15DC10 is also located behind control panel 208, and coupled to the control electronics.

Referring now to FIG. 6, the pump control panel 208 on the front of the housing 21 includes a series of buttons and indicator lights and a speed control. The speed control is at 209. It is a rotary knob as for a potentiometer. The two lights to the right of the speed control are for the pump. Light 213 indicates that the pump is off, while light 214 indicates that the pump is on. These have associated switch buttons 210 and 215, respectively under them to achieve these functions.

The next two lights to the right are 216 and 217. Light 216 indicates reversed flow, while light 217 indicates forward flow. The flow direction depends upon the direction of pump operation. Accordingly, the switches below each of these lights are a reverse switch 218 for the reverse flow, and a forward switch 219 for forward flow. The alert light 221 is intended to be illuminated whenever there is a leak such as sensed by the photo cell 167 of FIG. 6, or when some other malfunction is occurring. Switch 228 below light 221 tests the proper functioning of the leak detector and the associated light 221.

Referring again to FIG. 6, it should be understood that the face 153 in the pump housing, which has the cavity 159 therein to accommodate the pump rotor and rollers and the upper portion of which has the cam surface 154 as its wall, also extends to the right-hand and lower marginal edges of that portion of the housing, to thereby receive and pocket the couplings 156 and 157 and the intake hose 22 and outlet hose 23. Accordingly, these components remain securely in place until such time as it is desired to pull them forward out of their nesting cavity to facilitate replacement of the pump tube 152 by disconnecting the couplings 156 and 157. Shoulders 259 of the coupling pockets in face 153 abut the flanges 261 of the male threaded portions of the couplings (which are affixed to the pump tube) to prevent the pump tube from being pulled either way through the cavity 159 during either forward or reverse operation of the pump.

The lower portion 151A of door 151 slopes to the rear so that its lower edge is over the drip through (safety tray) 171 so that any paint which gets on its inside surface will drain into tray 171. Since this portion of the door slopes to the rear, and hose 23 extends straight down from the housing, a hose clearance notch 151B is provided in the door. A resilient gasket 230 is provided on the inside of the door around and above this notch. It has a key portion 230A (FIG. 6A and 6B) which extends into the discharge hose groove in housing face 153. It forms and seals around the hose 23 as best shown in FIG. 6A, and seals it at the level where the rest of the circumference of the hose is sealed by the hose groove constriction 229–231, so that any leakage above this level cannot run down the hose. Instead, it will be diverted and run downward and outward along edges 230B of the gasket so it will be further diverted to the drip trough by the rearward sloping wall of the door bottom portion 151A.

The pump housing also includes an electric cord from power plug 150 (FIG. 3) and a cord reel 232 (FIG. 2) behind the panel to the left of the door 151. Electric convenience outlets 233 are also provided on the rear of the housing.

Since the apparatus of the present invention can be used to apply a variety of materials, it is desirable to obtain the maximum available motor performance. For this purpose, it is desirable to avoid excessive motor loading, not only in the steady state, which is achievable by the above-mentioned spring adjustment nut 188, but also avoiding intermittent or pulse or shock-type loading. The provision of three pressure rollers assists in this effort.

OPERATION

In operation, the various components are assembled in much the manner described above. In the illustrated version, a single extension handle 26 is employed. It is connected to the roller mounting tube at the upper end, and to the swivel coupling assembly at the lower end, the swivel coupling assembly is connected to the control handle. The pump intake hose 22 is connected by a suitable conventional garden hose coupling 222 to a combination puncture spear and intake tube 223 in the lid 224 on the paint can 16. This spear may have a sharp end so that it can be actually punched directly through the top of the can of paint which has already been stirred or shaken on a power operated shaker or otherwise. Once the roller is installed, the painter is ready to paint.

During the painting operation, the power switch 212 is placed in the on condition, and the painter can then start the pump running by pushing the on button 215 under light 214. He pushes button 219 to provide forward pump operation. He can keep the paint flowing to the roller as long as the pump is running. The speed of the pump, and therefore the volume of delivery, can be controlled by the speed control knob 209. All of these functions except the power switch 212 and speed control can likewise be controlled by the handle 24, there being appropriate function controls on the handle for this purpose. Speed control at the handle is planned.

During a pause in painting, the off switch 210 under the off light 213 can be pushed. This stops the flow of paint. The configuration of the roller, which contains very little paint that has not been absorbed by the roller cover, prevents paint from dripping when the pump stops. If the painting is to be interrupted for a prolonged period of time or under circumstances where very wet and/or heavy coats are being applied, the motor can be switched to the reverse position by pushing the button 216 and the on button 215. Thereupon the pump will proceed to drain the entire system back into the paint can. Then, the roller itself can be placed in the hanger 234 in the "caddy" 226 in the front of the cart, and the hinged cover 236 closed until such time as the painter is ready to resume painting. Since the entire system is sealed and the cover closed on caddy 226, the painting may be interrupted for hours or days without having the paint dry, and painting may be resumed at any time.

If the painting will be terminated, the paint can be pumped back into the paint can as previously described. Then the entire system can be flushed by moving the paint intake spear from the paint can and inserting it in a can of appropriate cleaning solvent, (water in the case of water soluable paints) removing the roller cover and replacing the roller in the same can and operating the system to circulate solvent through the system in the normal direction. Another possibility is to reverse the pump operation, and then pump solvent from the roller end into the can.

In instances where it may be desirable for economy purposes, to use a unidirectional motor, the effect of reversing the pump can be achieved by reversing the locations of hoses 22 and 23 on their respective couplings 156 and 157, or by threading the pump tube through the pump in the opposite direction, and running the pump in the normal direction.

By making the coupling 222 to the intake spear in a size compatible with conventional garden hose fittings, the system can be drained and flushed without even running the pump motor, by simply connecting the coupling 222 to a hose bib. For this purpose, normally the pump tube 152 is either removed from the pump, or at least the load of the rollers against the tube is released by opening the door.

While the invention has been illustrated and described in detail in the drawings and foregoing description, the same is to be considered as illustrative and not restricted in character, it being understood that only the preferred embodiment has been shown and described and that all changes and modifications that come within the spirit of the invention are desired to be protected. In that regard, where the expressions "paint" or "painting" appear herein, they should be understood to embrace any fluidized materials regardless of whether they can be technically considered to be paint.

What is claimed is:

1. In a painting apparatus, paint mover means comprising:

a pump housing;

a pump in said housing and including a paint pumping tube, a tube support cam, and pressure applying rollers, and motor means for driving said rollers;

said motor means being movable relative to said housing to move said rollers toward and away from said cam, to respectively enable said rollers to press against said pump tube for pumping fluid through said tube, and disable said rollers from entrapping said tube against said cam, and thereby facilitate removal of said tube;

and a pump housing door pivotable about an axis nonparallel to rotational axes of said rollers, and linked to said motor means to move said motor means and provide access to said tube.

2. The paint mover means of claim 1 wherein:

said rollers include pressure rollers and idler rollers circularly spaced around an axis, said idler rollers being grooved to receive said pumping tube therein and confine said pumping tube in said housing.

* * * * *